United States Patent [19]

Fawzy

[11] Patent Number: 4,982,962

[45] Date of Patent: Jan. 8, 1991

[54] BRIDGE BOARD FOR OUTDOOR USE

[76] Inventor: Ehab Fawzy, 22 Chippewa Avenue, Nepean, Ontario, Canada, K2G 1X7

[21] Appl. No.: 369,012

[22] Filed: Jun. 20, 1989

[30] Foreign Application Priority Data

Jul. 26, 1988 [CA] Canada ..... 573059

[51] Int. Cl.[5] ..... A63F 1/10

[52] U.S. Cl. ..... 273/148 A

[58] Field of Search ..... 273/148 A, 309; 40/124.2, 124.4

[56] References Cited

U.S. PATENT DOCUMENTS

| | | | |
|---|---|---|---|
| 848,042 | 3/1907 | Musgrave | 273/148 A X |
| 1,009,018 | 11/1911 | Braine | 273/148 A X |
| 2,150,850 | 3/1939 | Smith | 273/148 A |
| 3,023,005 | 2/1962 | Hochman | 273/148 A X |

FOREIGN PATENT DOCUMENTS

| | | | |
|---|---|---|---|
| 2122098 | 1/1984 | United Kingdom | 273/148 A |

*Primary Examiner*—Edward M. Coven
*Assistant Examiner*—Raleigh W. Chiu
*Attorney, Agent, or Firm*—Eckert Seamans Cherin & Mellott

[57] ABSTRACT

A Bridge board for outdoor use, comprises a playing surface that can be placed between opposing pairs of players seated around the board and participating in a game of Bridge such that the players can deposit their cards on said playing surface during the game. The playing surface has at a first player station a first array of pockets designed to retian dummy's cards in exposed overlapping relationship such that dummy's cards are visible to the players seated around the board, a second array of pockets in the middle of the playing surface for retaining the cards of each trick as it is played such that the cards thereof are visible to eacy player, and third and fourth arrays of pockets at second and third player stations for separately retaining the tricks of the opposing pairs as the tricks are scored. The game can be conveniently played outdoors in the presence of wind.

6 Claims, 1 Drawing Sheet

BRIDGE BOARD FOR OUTDOOR USEcl

BACKGROUND OF THE INVENTION

This invention relates to a Bridge board for outdoor use, to permit the game of contract Bridge to be played in conditions where the cards would otherwise be liable to be blown off the board. The game of Bridge enjoys widespread popularity. It is probably the most popular card game, enjoyed by many people in all walks of life.

In order to play the game, four players, arranged in opposing pairs, normally sit around a Bridge table and play cards onto the table for the purpose of scoring tricks. One hand, known as dummy, lies exposed on the table. In play, the cards are placed face up on the table by each player, and the tricks won by the player are retained separately so that at the end of each game the winner of the trick can be determined.

Bridge is usually played indoors since the slightest wind will cause the cards to be blown off the table, which makes playing outdoors impractical. However, many people enjoy a game of bridge and in the summer would generally sit outdoors rather than remain indoors.

An object of the invention is therefore to provide a means for playing Bridge outdoors without fear of the playing cards being blown away by the wind.

SUMMARY OF THE INVENTION

According to the present invention there is provided a Bridge board for outdoor use, comprising a playing surface that can be placed between opposing pairs of players seated around the board and participating in a game of Bridge such that the players can deposit their cards on said playing surface during the game, said playing surface having at a first player station a first array of pockets designed to retain dummy's cards in exposed overlapping relationship such that dummy's cards are visible to the players seated around the board, a second array of pockets in the middle of the playing surface for retaining the cards of each trick as it is played such that the cards thereof are visible to each player, and third and fourth arrays of pockets at second and third player stations for separately retaining the tricks of the opposing pairs as the tricks are scored whereby the game can be played outdoors in the presence of wind.

Preferably, the first array, which is the dummy, comprises four columns of pockets with nine rows in each column. In this way, the four suits can be laid out with the cards in echelon relationship so as to be visible to all the players seated at the board.

The second array preferably comprises two columns of two pockets each so as to display up to four cards of each trick as it is played.

The third and fourth arrays are designed to retain the tricks as they are won, comprise four columns, with respectively six, three, three, one rows in each column.

BRIEF DESCRIPTION OF THE DRAWINGS

The invention will now be described in more detail, by way of example only, with reference to the accompanying drawings, in which.

DESCRIPTION OF PREFERRED EMBODIMENTS

Figure 1:
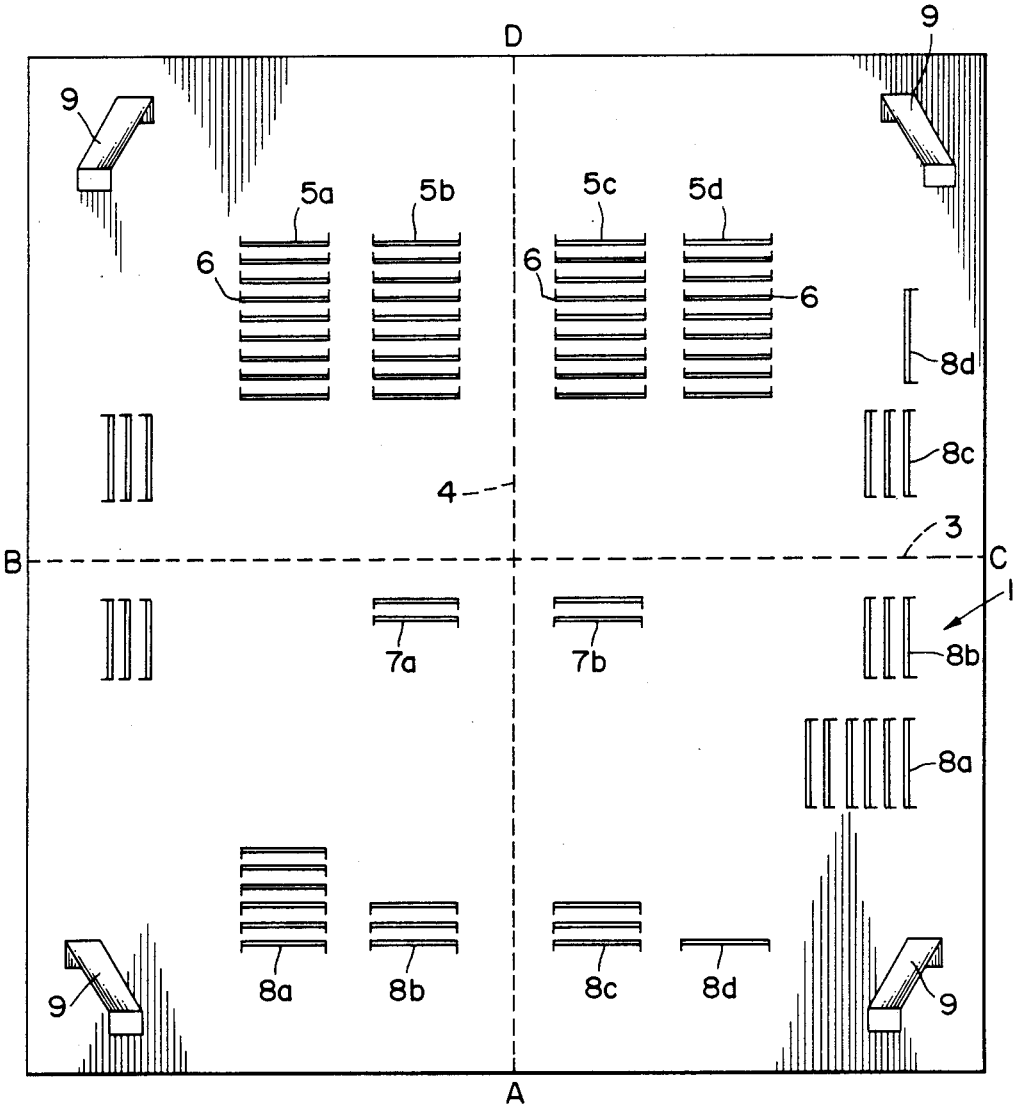
FIG. 1 is a plan view of a Bridge board according to the invention.
Figure 2:
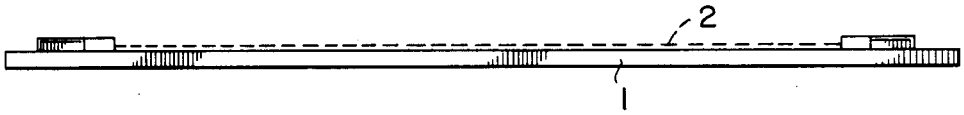
FIG. 2 is side view of the Bridge board shown in FIG. 1.

The Bridge board shown in the drawings comprises a stiff playing board 1, of cardboard or other suitable material, covered in a green baize cloth 2 defining a Bridge playing surface. The board can be folded first along fold line 3 and then along fold line 4 so as to be reduced to one-quarter its dimensions in the open configuration.

As with a game of Bridge around a conventional Bridge pair, the players normally sit at locations A, B, C, D alongside each edge of the board. Players A and D form one opposing pair, and players B and C form the other opposing pair.

In the configuration shown in FIG. 1, player A has the hand and player D is the dummy. The dummy position contains four columns 5, each having nine rows of pockets 6. Each pocket 6 is formed by a slit in the baize covering 2 and the rows are arranged so that the playing cards of each suit can be fitted into the pockets 6 in overlapping relationship. For example, the left-most column 5*a* might hold the clubs suit, with the cards being inserted in the pockets and displayed in an otherwise conventional manner.

In the middle of the board are arranged two columns, *7a, 7b* of two rows of pockets each. These pockets, which are formed in the same manner as the pocket 6, are used to retain the cards of each trick during a game.

Player A, opposing dummy, who is the player who has the hand in a game, also has four columns of pockets, 8*a*, 8*b*, 8*c*, 8*d*. Player C has the same configuration. These pockets allow players A and C to retain tricks as they are scored during play. The tricks are first placed in the column 8*a*, which contains six rows, which is the base minimum required before contract tricks are scored. At the end of the game, when counting up the tricks, the tricks in column 8*a* are ignored, and the tricks in columns 8*b*, 8*c*, 8*d* give a quick indication as to the status of the game with regard to the contract.

Player B, who does not retain tricks merely has two rows of three pockets. These are to receive playing cards during the initial deal of the hand. The pockets of players A, C, D serve the same purpose. The dealer merely places the cards into the pockets in any order.

To the right of each player is a small rectangular bracket 9 designed to accommodate a complete pack of cards. After shuffling, the pack can be placed in the bracket to the right of the shuffling player.

Unlike a conventional bridge table, it is necessary to rotate the board during play so as to ensure that the dummy hand lies opposite the player who bids the contract. As a practical matter, this is not a disadvantage because during bidding each player has to pick up his full hand of cards and retain it in his hand. Once the contract has been bid, the players merely rotate the board into the correct configuration and then the player bidding the contract lays out the cards in the dummy hand using the array of four columns with nine rows each to expose all the cards. In the unlikely event that one suit contains more than nine cards, the suit can be continued into the adjacent column. In that event the chances are that there would be a void in one suit.

During play, the game proceeds as normally. The only difference over a normal game of bridge is that as the cards are played, instead of just placing them face down on the board, the players actually insert them into one of the free pockets *7a, 7b*. At the end of the round, the winning player removes all four cards of the trick and inserts them into a unique pocket with the individual lying in echelon relationship so that the number of tricks scored can be readily determined.

I claim:

1. A Bridge board for outdoor use, comprising a stiff board having a playing surface that can be placed between opposing pairs of players seated around the board and participating in a game of Bridge such that the players can place their playing cards on said playing surface during the game, said playing surface having at a first player station a first array of pockets designed to retain a respective dummy's playing in exposed overlapping relationship such that dummy's playing cards are visible to the players seated around the board, said pockets of said first array being defined by four columns of at least nine parallel slits in said playing surface, a second array of pockets in the middle of the playing surface for retaining the playing cards of each trick as it is played such that the playing cards thereof are visible to each player, said pockets of said second array being defined by four slits in said playing surface, third and fourth similar arrays of pockets at adjacent second and third player stations for accommodating, in overlapping relationship, tricks taken by each pair of players, one of said second and third player stations being located immediately adjacent said first player station, said pockets of said third and fourth arrays being defined by a plurality of columns of parallel slits in said playing surface, at least one of said columns of said plurality consisting of six slits, and the total number of slits in each of said third and fourth arrays being thirteen, said pockets of said third and fourth arrays thereby permitting the tricks taken by the opposing pairs of players to be separately retained such the number of contract tricks taken by each pair can be easily determined at any point in the game, and a bracket member on said playing surface to one side of each player station for retaining a pack of playing cards not in use during a game, whereby the Bridge game can be played outdoors in the presence of wind.

2. A Bridge board as claimed in claim 1, wherein said second array comprises two columns of two rows each.

3. A Bridge board as claimed in claim 1, wherein said third and fourth arrays of pockets each comprise a first column with six pockets, two middle columns with three pockets each, and a fourth column with one pocket.

4. A Bridge board as claimed in claim 1, wherein a fifth array of pockets is provided at a fourth player station, said fifth array comprising two columns of three pockets each.

5. A Bridge board as claimed in claim 1, wherein said playing surface is covered with fabric and said slits are formed in said fabric.

6. A Bridge board as claimed in claim 1, said board being square and further comprising orthogonal crease lines extending thereacross, whereby said board can be conveniently folded in four while not in use.

* * * * *